US005412928A

United States Patent [19]

Reithel

[11] Patent Number: 5,412,928

[45] Date of Patent: May 9, 1995

[54] DEHYDRATION DEVICE

[76] Inventor: Frederick Reithel, 623 Caldonia Rd., Dix Hills, N.Y. 11746

[21] Appl. No.: 183,819

[22] Filed: Jan. 21, 1994

[51] Int. Cl.[6] ..... F26B 25/00

[52] U.S. Cl. ..... 34/104; 34/106; 34/440

[58] Field of Search ..... 34/104, 105, 106, 103, 34/437, 439, 440, 239; 223/85

[56] References Cited

U.S. PATENT DOCUMENTS

| | | | |
|---|---|---|---|
| 629,944 | 8/1899 | Witmer | 34/104 |
| 1,759,179 | 5/1930 | Wiesman | 34/105 |
| 1,833,631 | 11/1931 | Wilsey | 34/104 |
| 2,118,786 | 5/1938 | Chestnut | 34/106 |
| 2,883,092 | 4/1959 | McMillan | 34/104 |
| 3,207,392 | 9/1965 | Ericson | 223/85 |
| 3,675,338 | 7/1972 | Maki | 34/239 |
| 4,085,519 | 4/1978 | Masika | 34/104 |
| 4,592,497 | 6/1986 | Georges | 223/85 |
| 5,082,152 | 1/1992 | Chen | 223/89 |

FOREIGN PATENT DOCUMENTS

| | | | |
|---|---|---|---|
| 937165 | 12/1955 | Germany | 34/103 |
| 1485060 | 5/1969 | Germany | 34/104 |
| 122463 | 9/1979 | Japan | 34/104 |
| 3118099 | 5/1991 | Japan | 34/239 |

*Primary Examiner*—Henry A. Bennet
*Assistant Examiner*—William C. Doerrler
*Attorney, Agent, or Firm*—Michael I. Kroll

[57] ABSTRACT

A dehydration device is provided which consists of a portable framework. Structures are for suspending from the portable framework various components of turnout uniforms that are used by fire and rescue personnel. A mechanism is coupled to the portable framework for removing moisture in an accelerated time interval from the various components of the turnout uniforms.

13 Claims, 2 Drawing Sheets

DEHYDRATION DEVICE

BACKGROUND OF THE INVENTION

1. Field of the Invention

The instant invention relates generally to dryers and more specifically it relates to a dehydration device.

2. Description of the Prior Art

Numerous dryers have been provided in prior art that are machines which remove water from clothes by tumbling the clothes through forced hot air systems. While these units may be suitable for the particular purpose to which they address, they would not be as suitable for the purposes of the present invention as heretofore described.

SUMMARY OF THE INVENTION

A primary object of the present invention is to provide a dehydration device that will overcome the shortcomings of the prior art devices.

Another object is to provide a dehydration device in which its function is to accelerate the time needed to remove the moisture from turnout uniforms that are required wearing apparel for the safety of fire and rescue personnel.

An additional object is to provide a dehydration device in which the various components of the turnout uniforms are suspended from the device, so that air heated or at room temperature can be forced through the components to remove the moisture.

A further object is to provide a dehydration device that is simple and easy to use.

A still further object is to provide a dehydration device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
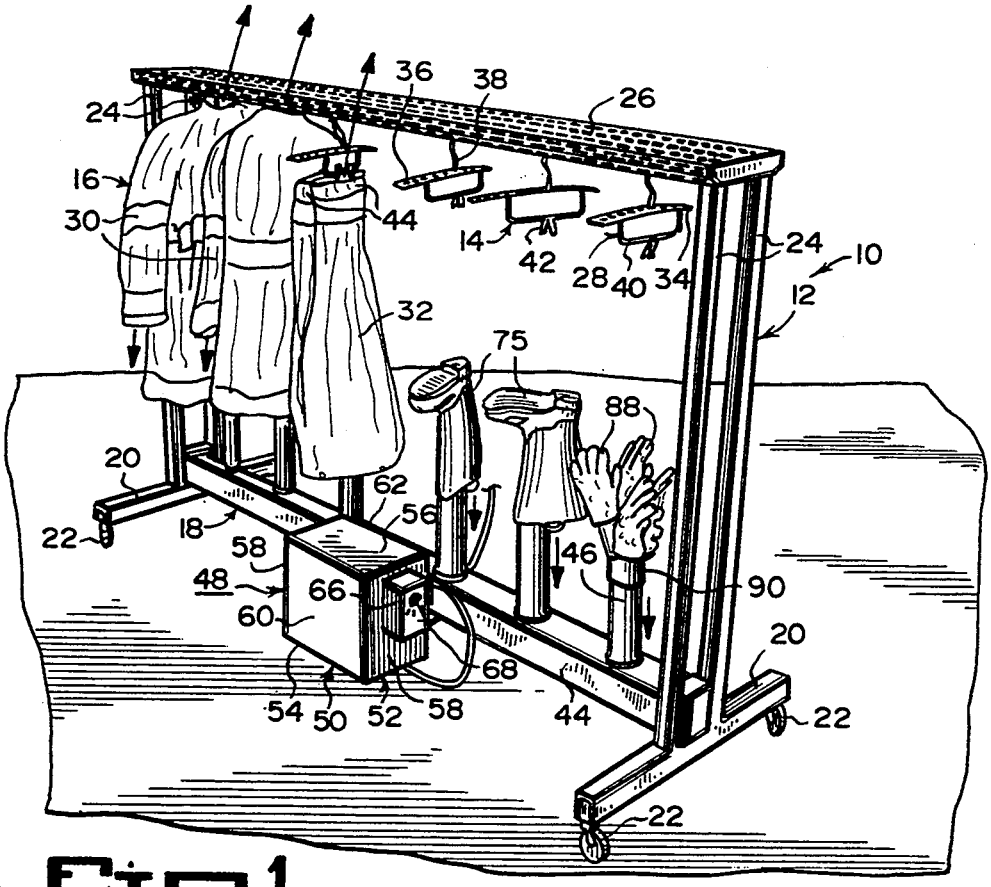
FIG. 1 is a perspective view of the instant invention in use.
Figure 2:
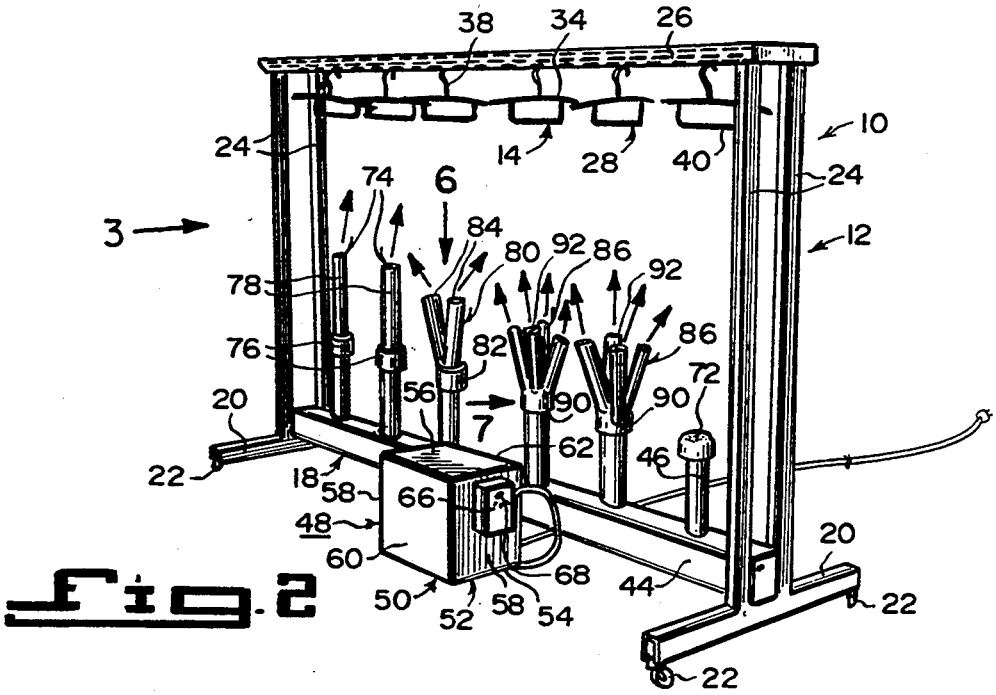
FIG. 2 is a perspective view of the instant invention per se.
Figure 4:
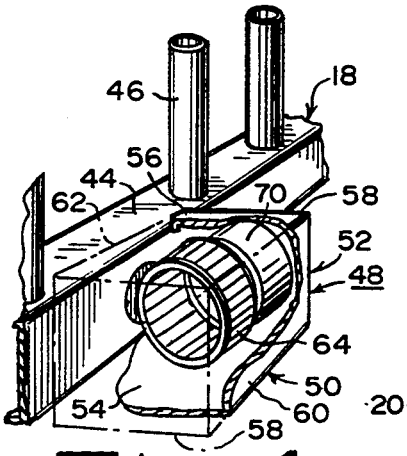
FIG. 4 is an enlarged perspective view with parts broken away taken in the direction of arrow 4 in FIG. 3, showing the internal components of the control box in greater detail.
Figure 3:
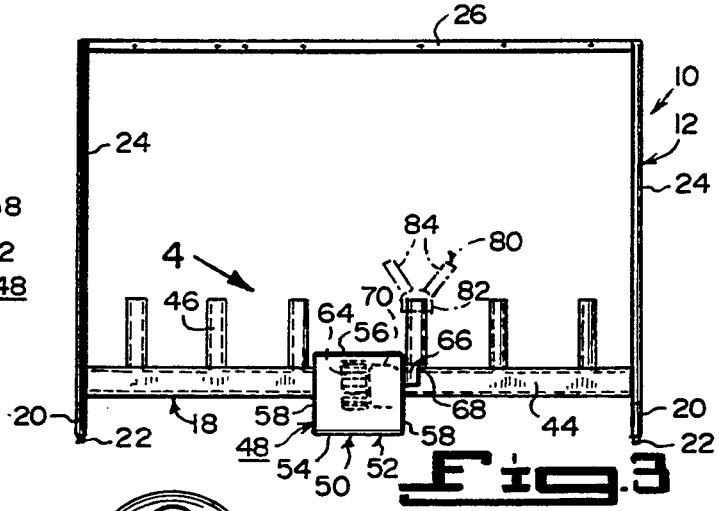
FIG. 3 is a front view taken in the direction of arrow 3 in FIG. 2.

Turning now descriptively to the drawings, in which similar reference characters denote similar elements throughout the several views, FIGS. 1 through 3 illustrates a dehydration device 10, which consists of a portable framework 12. Structures 14 are for suspending from the portable framework 12, various components of turnout uniforms 16 that are used by fire and rescue personnel, A mechanism 18 is coupled to the portable framework 12, for removing moisture in an accelerated time interval from the various components of the turnout uniforms 16.

The portable framework 12 includes a pair of spaced apart horizontal leg bases 20. Two pair of casters 22 are provided, with each pair of casters 22 mounted to opposite ends of each horizontal leg base 20. Two pair of stanchions 24 are also provided, with each pair of stanchions 24 affixed in an upstanding spaced apart position onto each horizontal leg base 20. Each horizontal leg base 20 is transversely aligned with respect to each pair of stanchions 24. A perforated top rack 26 extends horizontally between the upper ends of the two pair of stanchions 24.

The suspending structures 14 are a plurality of special hangers 28, to engage with the top rack 26 in spaced apart relationships. Some of the various components of the turnout uniforms 16, such as turnout coats 30 and bunker pants 32 can hang down from the special hangers 28.

Figure 5:
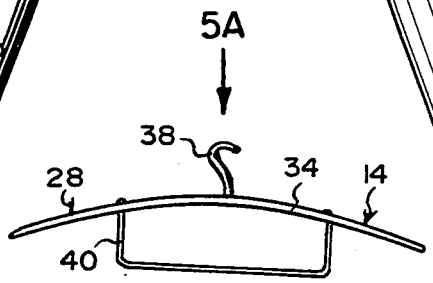
FIG. 5 is an enlarged elevational view of one of the hangers.
Figure 5A:
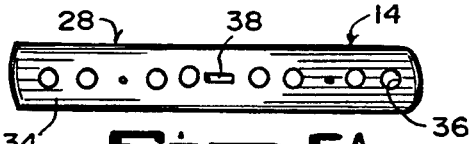
FIG. 5A is a top view taken in the direction of arrow 5A in FIG. 5.

Each special hanger 28, as best seen in FIGS. 5 and 5A, consists of a flat bow 34 having a plurality of apertures 36 therethrough. A hook 38 is affixed to an upper apex central portion of the bow 34. The hook 38 can engage with the top rack 26, while a turnout coat 30 can be hung onto the bow 34. A U-shaped carry member 40 is attached to the underside of the bow 34. A clip 42 is on the carry member 40, to hold the cuffs 44 of a pair of bunker pants 32, so that the bunker pants 32 will hang upside down.

The moisture removing mechanism 18 includes a manifold conduit 44 extending horizontally between the lower ends of the pair of stanchions 24 adjacent the leg bases 20 directly below and parallel with the top rack 26. A plurality of air outlet pipes 46 are spaced apart in upright positions on top of the manifold conduit 44 directly under each special hanger 28. An assembly 48 is fluidly connected to a side of the manifold conduit 44 for forcing air through the manifold conduit 44 and out of all of the air outlet pipes 46. Any wet turnout coats 30 and bunker pants 32 hanging down from the special hangers 28 will be dried by the forced air.

The air forcing assembly 48 is a control box 50 that is fluidly connected to the side of the manifold conduit 44. The control box 50 consists of a housing 52, having a bottom wall 54, a top wall 56, a pair of side walls 58, a front wall 60 and a rear wall 62 having an opening therethrough connected into the manifold conduit 44. A blower 64 is in the housing 52 for supplying the forced air into the manifold conduit 44. A heater 70 is also in the housing which when activated will heat the forced air before entering the manifold conduit 44.

A relay/timer 66 is mounted onto one side wall 58 of the housing 52 and is electrically connected to the blower 64 and the heater 70. A three-way selector switch 68 is on and is electrically connected to the relay/timer 66.

When the three-way selector switch 68 is turned to a first position, the blower 64 will operate. When the three-way selector switch 68 is turned to a second position, the blower 64 and the heater 70 will operate. When the three-way selector switch 68 is turned to a third position, the blower 64 and the heater 70 will not operate. A sealing cap 72 can be mounted in a removable manner upon a free end of one air outlet pipe 46, so as to prevent the forced air from exiting the air outlet pipe 46 when not in use.

A boot dryer adaptor 74 can be mounted in a removable manner upon a free end of one air outlet pipe 46, so that an inverted wet boot 75 can be placed upon the boot dryer adaptor 74 to be dried therefrom. The boot dryer adaptor 74 includes a cap 76 that fits upon the free end of the air outlet pipe 46. A perforated tube 78 extends upwardly from the cap 76, so that the inverted wet boot 75 can be placed upon the perforated tube 78.

Figure 6:
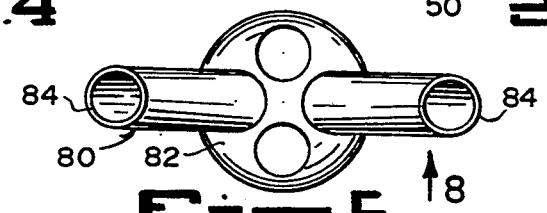
FIG. 6 is an enlarged top view of the bunker pants dryer adaptor taken in the direction of arrow 6 in FIG. 2.
Figure 8:
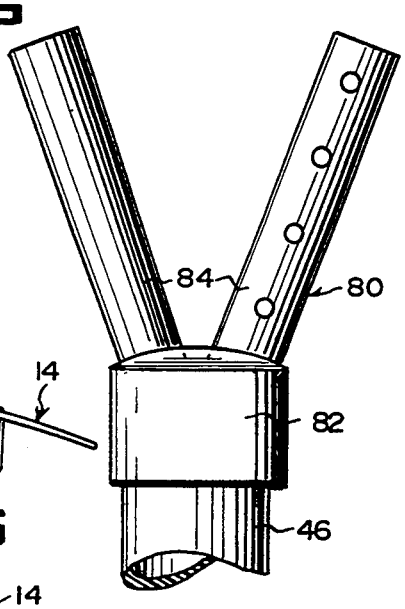
FIG. 8 is an elevational view of the bunker pants dryer adaptor taken in the direction of arrow 8 in FIG. 6.

A bunker pants dryer adaptor 80 can also be mounted in a removable manner upon a free end of one air outlet pipe 46. An inverted wet pair of bunker pants 32 hanging down from one special hanger 28, can be placed over the bunker pants dryer adaptor 80 to be dried therefrom. The bunker pants dryer adaptor 80, as best seen in FIGS. 6 and 8, contains a cap 82 that fits upon the free end of the air outlet pipe 46. Two perforated tubes 84 extend upwardly at an angle from opposite sides of the cap 82, to fit into each leg portion of the inverted wet pair of bunker pants 32.

A glove dryer adaptor 86 can be mounted in a removable manner upon a free end of one air outlet pipe 46. Up to four inverted wet gloves 88 can be placed upon the glove dryer adaptor 86 to be dried therefrom.

Figure 7:
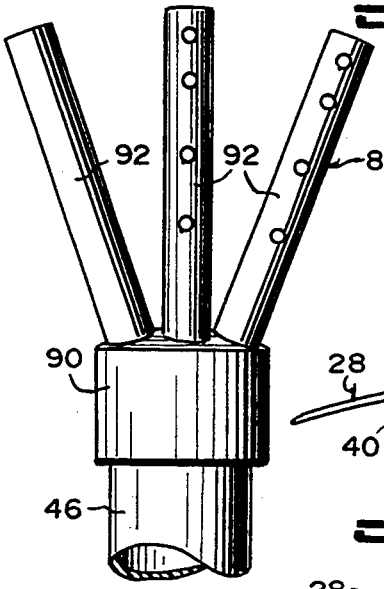
FIG. 7 is an enlarged elevational view of the glove dryer adaptor taken in the direction of arrow 7 in FIG. 2.

The glove dryer adaptor 86, as best seen in FIG. 7, includes a cap 90 that fits upon the free end of the air outlet pipe 46. Four perforated tubes 92 extend upwardly at angles radially about the cap 90. Each of the inverted wet gloves 88 can be placed upon each perforated tube 92.

LIST OF REFERENCE NUMBERS

10 dehydration device
12 portable framework
14 suspending structure on 12
16 turnout uniform
18 moisture removing mechanism on 12
20 leg base
22 caster
24 stanchion
26 perforated top rack
28 special hanger for 14
30 turnout coat
32 bunker pants
34 flat bow of 28
36 aperture in 34
38 hook on 34
40 U-shaped carry member on 34
42 clip on 40
44 manifold conduit
46 air outlet pipe
48 air forcing assembly
50 control box for 48
52 housing
54 bottom wall of 52
56 top wall of 52
58 side wall of 52
60 front wall of 52
62 rear wall of 52
64 blower in 52
66 relay/timer on 58
68 three-way selector switch on 66
70 heater
72 sealing cap
74 boot dryer adaptor
75 boot
76 cap of 74
78 perforated tube of 74
80 bunker pants dryer adaptor
82 cap of 80
84 perforated tube of 80
86 glove dryer adaptor
88 glove
90 cap of 86
92 perforated tube of 86

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A dehydration device which comprises:

a) a portable framework comprising a pair of spaced apart horizontal leg bases, two pair of casters, each said pair of casters mounted on opposite ends of each said horizontal leg base, two pair of stanchions, each said pair of stanchions affixed in an upstanding spaced apart position onto each said horizontal leg base, so that each said horizontal leg base is transversely aligned with respect to each said pair of stanchions, a perforated top rack extending horizontally between the upper ends of said two pair of stanchions, and a manifold conduit extending horizontally between the lower ends of said pair of stanchions adjacent said leg bases directly below and parallel with said top rack;

b) means comprising special hangers for suspending from said top rack various components of turnout uniforms that are used by fire and rescue personnel; and c) means coupled to said portable framework for removing moisture in an accelerated time interval from the various components of the turnout uniforms comprising a plurality of air outlet pipes spaced apart in upright positions on top of said manifold conduit said pipes communicating with the interior of said conduit and means fluidly connected to a side of said manifold conduit for forcing air through said manifold conduit and out of all of said air outlet pipes, so that any wet turnout coats and bunker pants hanging down from said top rack will be dried by the forced air.

2. A dehydration device as recited in claim 1, wherein each said special hanger includes:

a) a flat bow having a plurality of apertures therethrough; and b) a hook affixed to an upper apex central portion of said bow, so that said hook can engage with said top rack, while a turnout coat can be hung onto said bow.

3. A dehydration device as recited in claim 2, wherein each said special hanger further includes:

a) a U-shaped carry member attached to the underside of said bow; and b) a clip on said carry member to hold the cuffs of a pair of bunker pants, so that the bunker pants will hang upside down.

4. A dehydration device as recited in claim 3, wherein said air forcing means is a control box that is fluidly connected to the side of said manifold conduit.

5. A dehydration device as recited in claim 4, wherein said control box includes:

a) a housing having a bottom wall, a top wall, a pair of side walls, a front wall and a rear wall having an opening therethrough connected into said manifold conduit; and b) a blower in said housing for supplying the forced air into said manifold conduit.

6. A dehydration device as recited in claim 5, wherein said control box further includes a heater in said housing, which when activated will heat the forced air before entering said manifold conduit.

7. A dehydration device as recited in claim 6, wherein said control box further includes:

a) a relay/timer mounted onto one said side wall of said housing and electrically connected to said blower and said heater; and b) a three-way selector switch on and electrically connected to said relay/timer, so that when said three-way selector switch is turned to a first position said blower will operate, turned to a second position said blower and said heater will operate and turned to a third position said blower and said heater will not operate.

8. A dehydration device as recited in claim 7, further including a sealing cap mounted in a removable manner upon a free end of one said air outlet pipe, so as to prevent the forced air from exiting said air outlet pipe when not in use.

9. A dehydration device as recited in claim 7, further including a boot dryer adaptor, a bunker pants drying adaptor, and a glove drying adaptor which can be selectively mounted in a removable manner upon a free end of an air outlet pipe for selective drying of wet boots, bunker pants and gloves.

10. A dehydration device as recited in claim 9, wherein said boot dryer adaptor includes:

a) a cap that fits upon the free end of said air outlet pipe; and b) a perforated tube extending upwardly from said cap, so that the inverted wet boot can be placed upon said perforated tube.

11. A dehydration device as recited in claim 7, an inverted wet pair of bunker pants hanging down from one said special hanger can be placed over said bunker pants dryer adaptor to be dried therefrom.

12. A dehydration device as recited in claim 11, wherein said bunker pants dryer adaptor includes:

a) a cap that fits upon the free end of said air outlet pipe; and b) two perforated tubes extending upwardly at an angle from opposite sides of said cap to fit into each leg portion of said inverted wet pair of bunker pants.

13. A dehydration device as recited in claim 12, wherein said glove dryer adaptor includes:

a) a cap that fits upon the free end of said air outlet pipe; and b) four perforated tubes extending upwardly at angles radially about said cap, so that each of the inverted wet gloves can be placed upon each said perforated tube.

* * * * *